US010178884B2

(12) United States Patent
Suzuki

(10) Patent No.: US 10,178,884 B2
(45) Date of Patent: Jan. 15, 2019

(54) KNITTED GLOVE AND METHOD FOR PRODUCING KNITTED FABRIC CONTAINED IN KNITTED GLOVE

(71) Applicant: SHOWA GLOVE CO., Hyogo (JP)

(72) Inventor: Wataru Suzuki, Hyogo (JP)

(73) Assignee: SHOWA GLOVE CO., Hyogo (JP)

( * ) Notice: Subject to any disclaimer, the term of this patent is extended or adjusted under 35 U.S.C. 154(b) by 0 days.

(21) Appl. No.: 15/625,459

(22) Filed: Jun. 16, 2017

(65) Prior Publication Data

US 2017/0360127 A1 Dec. 21, 2017

(30) Foreign Application Priority Data

Jun. 21, 2016 (JP) ..... 2016-122612

(51) Int. Cl.

| | |
|---|---|
| ***D04B 1/28*** | (2006.01) |
| ***A41D 19/015*** | (2006.01) |
| ***A41D 19/00*** | (2006.01) |
| ***D04B 21/20*** | (2006.01) |
| ***D04B 1/18*** | (2006.01) |

(52) U.S. Cl.

CPC ..... *A41D 19/01505* (2013.01); *A41D 19/00* (2013.01); *D04B 1/18* (2013.01); *D04B 1/28* (2013.01); *D04B 21/207* (2013.01); *A41D 2500/10* (2013.01); *D10B 2403/0114* (2013.01)

(58) Field of Classification Search

CPC ... D04B 1/18; D04B 1/28; D04B 7/34; D04B 7/16; D04B 9/58; D04B 21/207; A41D 19/00; A41D 19/01505

See application file for complete search history.

(56) References Cited

U.S. PATENT DOCUMENTS

| | | | | |
|---|---|---|---|---|
| 3,788,103 | A * | 1/1974 | Asai | D04B 1/28 66/174 |
| 4,470,251 | A * | 9/1984 | Bettcher | A41D 19/01511 57/230 |
| 5,119,512 | A * | 6/1992 | Dunbar | A41D 19/01511 139/420 R |
| 5,321,960 | A * | 6/1994 | Whitt | A41D 31/0055 57/236 |

(Continued)

FOREIGN PATENT DOCUMENTS

| | | |
|---|---|---|
| EP | 2155942 A1 | 2/2010 |
| EP | 2208814 A1 | 7/2010 |

(Continued)

*Primary Examiner* — Danny Worrell

(74) *Attorney, Agent, or Firm* — The Webb Law Firm

(57) ABSTRACT

A knitted glove includes a knitted fabric including, multiple stages of a first course each of which has a plurality of first loops and a first cross element to connect the first loops to each other and in which the plurality of first loops are aligned in the course direction; and multiple stages of a second course each of which has a plurality of second loops and in which the plurality of second loops are aligned in the course direction, the first knitting yarn constituting the first course has an elongation rate of 12.5% or more, a second knitting yarn includes a yarn containing a cut resistant fiber, between at least one set of two adjacent first loops in one stage of the first course, a loop in another stage of the courses is arranged, and the first cross element is knitted so as to cross over the loop.

4 Claims, 13 Drawing Sheets

(56) References Cited

U.S. PATENT DOCUMENTS

| | | | | | |
|---|---|---|---|---|---|
| 5,442,815 | A * | 8/1995 | Cordova | A61B 42/10 | 2/161.7 |
| 5,799,333 | A * | 9/1998 | McGarry | D04B 1/28 | 2/161.6 |
| 6,161,400 | A * | 12/2000 | Hummel | A41D 19/01505 | 2/16 |
| 6,756,330 | B1 | 6/2004 | Heirbaut et al. | | |
| 7,934,397 | B2 * | 5/2011 | Zhu | A41D 19/01505 | 2/16 |
| 8,322,167 | B2 | 12/2012 | Dias et al. | | |
| 2016/0073713 | A1 | 3/2016 | Takata | | |

FOREIGN PATENT DOCUMENTS

| | | | |
|---|---|---|---|
| EP | 3002352 | A1 | 4/2016 |
| JP | 2002534615 | A | 10/2002 |

* cited by examiner

KNITTED GLOVE AND METHOD FOR PRODUCING KNITTED FABRIC CONTAINED IN KNITTED GLOVE

CROSS-REFERENCE TO RELATED APPLICATION

This application claims priority to Japanese Patent Application No. 2016-122612 filed Jun. 21, 2016, the disclosure of which is hereby incorporated in its entirety by reference.

BACKGROUND OF THE INVENTION

Field of the Invention

The present invention relates to a knitted glove and a method for producing a knitted fabric contained in the knitted glove.

Background Art

Conventionally, a knitted glove containing a knitted fabric that includes: multiple stages of a first course each of which has a plurality of first loops and a first cross element configured to connect the first loops to each other and in which the plurality of first loops are aligned in the course direction; and multiple stages of a second course each of which has a plurality of second loops and a second cross element configured to connect the second loops to each other and in which the plurality of second loops are aligned in the course direction, wherein between two adjacent first loops in one stage of the first course, a second loop in another stage of the second course is arranged, between two adjacent second loops in one stage of the second course, a first loop in another stage of the first course is arranged, the first cross element is knitted so as to cross over the second loop, and the second cross element is knitted so as to cross over the first loop is known (JP 2002-534615 T).

Since the aforementioned knitted fabric is knitted so that the first cross element in the first course crosses over the second loop in the second course, and the second cross element in the second course crosses over the first loop in the first course, it has large thickness as compared with a knitted fabric by simple flat knitting. Therefore, the knitted glove containing the aforementioned knitted fabric has high cut resistance as compared with a knitted glove containing a knitted fabric by simple plain knitting.

Further, in the knitted glove containing the aforementioned knitted fabric, it is also known to use metal composite yarns having excellent cut resistance for a first knitting yarn forming the first loops and a second knitting yarn forming the second loops, in order to further enhance the cut resistance of the knitted fabric (see the description of European Patent Application Publication No. 2155942).

SUMMARY OF THE INVENTION

However, there is a problem that a knitted glove having enhanced cut resistance has poor flexibility and poor comfort in wearing (modest tightening that is not too loose and not too strong cannot be achieved). In the case of poor flexibility and poor comfort in wearing, a wearer's hand tends to be tired easily when the wearer has worked for a long time. As a result, the working efficiency is reduced.

In view of such a problem, it is an object of the present invention to provide a knitted glove having excellent cut resistance, excellent flexibility, and excellent comfort in wearing, comparatively, and a method for producing a knitted fabric contained in the knitted glove.

A knitted glove according to the present invention includes a knitted fabric, and the knitted fabric includes: multiple stages of a first course each of which has a plurality of first loops and a first cross element configured to connect the first loops to each other and is constituted by a first knitting yarn and in which the plurality of first loops are aligned in the course direction; and multiple stages of a second course each of which has a plurality of second loops and is constituted by a second knitting yarn and in which the plurality of second loops are aligned in the course direction, and the first knitting yarn constituting the first course has an elongation rate of 12.5% or more, the second knitting yarn constituting the second course includes a yarn containing a cut resistant fiber, between at least one set of two adjacent first loops in one stage of the first course, a loop in another stage of the courses is arranged, and the first cross element is knitted so as to cross over the loop.

In the aforementioned knitted glove, the configuration may be such that the second course further has a second cross element configured to connect the second loops to each other, between at least one set of two adjacent second loops in one stage of the second course, a loop in another stage of the courses is arranged, and the second cross element is knitted so as to cross over the loop.

In the aforementioned knitted glove, the configuration may be such that the first knitting yarn includes a composite yarn that has a core material containing an elastic fiber, and a coating layer formed by winding a coating fiber around the outer circumference of the core material.

In the aforementioned knitted glove, the configuration may be such that the second knitting yarn includes a composite yarn that has a core material containing a cut resistant fiber, and a coating layer formed by winding a coating fiber around the outer circumference of the core material.

A method for producing a knitted fabric contained in the knitted glove according to the present invention includes: a plurality of first course knitting steps of knitting a first course using a first knitting yarn by aligning a plurality of first loops in the course direction so as to be connected to each other by a first cross element; and a plurality of second course knitting steps of knitting a second course using a second knitting yarn by aligning a plurality of second loops in the course direction, wherein at least one of the plurality of first course knitting steps is a step of knitting the first course so that the first cross element crosses over a loop in another stage of the courses, the first knitting yarn constituting the first course has an elongation rate of 12.5% or more, and the second knitting yarn constituting the second course includes a yarn containing a cut resistant fiber.

In the aforementioned method for producing a knitted fabric contained in the knitted glove, using a flat knitting machine including needle beds having knitting needles provided side by side in a direction in which the courses of the knitted fabric extend, a first yarn feeder configured to feed the first knitting yarn to knitting needles, and a second yarn feeder configured to feed the second knitting yarn to knitting needles, at least one of the first course knitting steps may be forming the first cross element so as to cross over a loop formed by the knitting needle that has not been used above in the first course knitting step among the loops in the course knitted in the one-step-ahead course knitting step by feeding the first knitting yarn from the first yarn feeder to a knitting needle in the needle beds without using a knitting needle that has been used in a course knitting step ahead of the first course knitting step.

In the aforementioned method for producing a knitted fabric, at least one of the second course knitting steps may be forming the second cross element so as to cross over a loop formed by the knitting needle that has not been used above in the second course knitting step among the loops in the course knitted in the one-step-ahead course knitting step by feeding the second knitting yarn from the second yarn feeder to a knitting needle in the needle beds without using a knitting needle that has been used in a course knitting step ahead of the second course knitting step.

DETAILED DESCRIPTION OF THE PREFERRED EMBODIMENT

Figure 1:
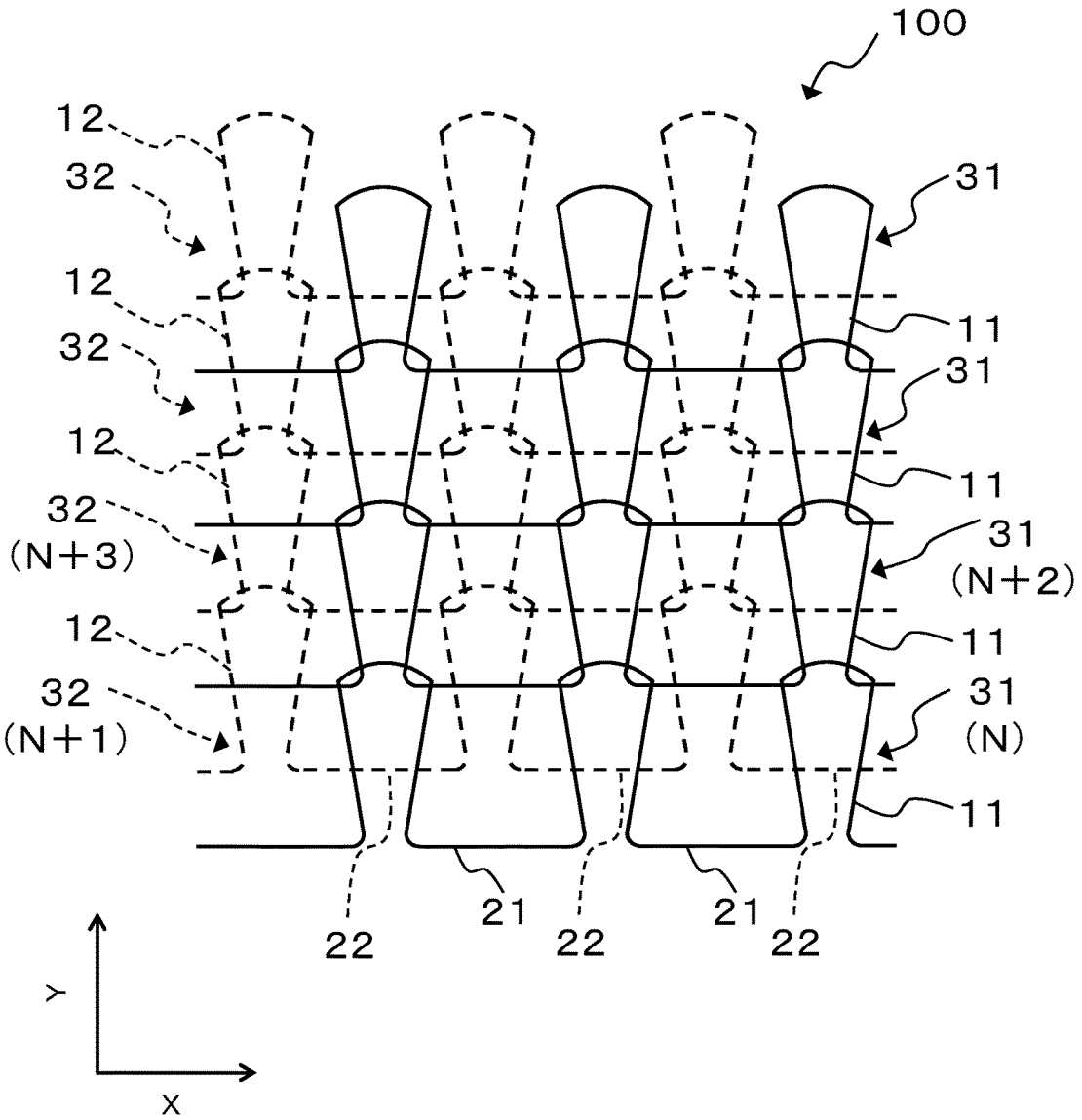
FIG. 1 is a view showing a knitted fabric contained in a knitted glove according to a first embodiment of the present invention.

A knitted glove according to the present invention includes a knitted fabric, and the knitted fabric includes: multiple stages of a first course each of which has a plurality of first loops and a first cross element configured to connect the first loops to each other and is constituted by a first knitting yarn and in which the plurality of first loops are aligned in the course direction; and multiple stages of a second course each of which is constituted by a second knitting yarn and in which a plurality of second loops are aligned in the course direction, wherein the first knitting yarn constituting the first course has an elongation rate of 12.5% or more, the second knitting yarn constituting the second course has a yarn containing a cut resistant fiber, between at least one set of two adjacent first loops in one stage of the first course, a loop in another stage of the courses is arranged, and the first cross element is knitted so as to cross over the loop. The phrase "between at least one set of two adjacent first loops in one stage of the first course, a loop in another stage of the courses is arranged" means that a loop in another stage of the first or second course is arranged between at least one of a plurality of sets of two adjacent first loops in one stage of the first course.

In this description, the elongation rate means the degree of elongation of a yarn measured when a specific load is applied to the hanging yarn. Specifically, the elongation rate means the value obtained as follows: (1) one end of the yarn with a length of 50 cm is held by a clamp, and a load of 30 g is applied to the yarn hanging downward; (2) after the lapse of 10 seconds, a mark is provided at a position (L2) of 40 cm from the one end of the aforementioned yarn in the hanging direction, and thereafter the load of 30 g is removed from the aforementioned yarn, which is held for 2 minutes; (3) a load of 0.25 g is applied thereto, with the aforementioned yarn hanging downward, and after the lapse of 10 seconds, the length (L1) from the one end of the aforementioned yarn to the mark is measured; (4) using the values of L1 and L2, the elongation rate is calculated by rounding off to one decimal place by the formula of $(L2-L1)/L1\times100$; and (5) the values of the elongation rate determined by performing steps (1) to (4) 20 times are arithmetically averaged. In the case where the yarn is formed by combining two or more yarns, the elongation rate means the degree of elongation of the yarn measured in the state where the two yarns are combined. Specifically, the elongation rate means a value calculated as follows: (1') one end of each of the yarns with a length of 50 cm is held by a clamp, and a load of 30 g is applied to each yarn hanging downward; (2') after the lapse of 10 seconds, a mark is provided at a position (L2) of 40 cm from the one end of each yarn in the hanging direction, thereafter the yarns are bundled at the marked positions, and the load of 30 g is removed from the yarns, which are held for 2 minutes; (3') next, with the bundled yarns hanging downward, a load of 0.25 g is applied thereto, and after the lapse of 10 seconds, the length (L1) from the one end of each yarn to the mark is measured; and the aforementioned steps (4) and (5) are performed. Further, the cut resistant fiber means a fiber having a tensile strength, as measured according to chapter 8.5.1 in the test methods for chemical fiber filament yarns of JIS L 1013, of 1000 $N/mm^2$ or more.

In the aforementioned knitted glove, the configuration may be such that the second course further has a second cross element configured to connect the second loops to each other, between at least one set of two adjacent second loops in one stage of the second course, a loop in another stage of the courses is arranged, and the second cross element is knitted so as to cross over the loop.

As the first knitting yarn for knitting the first course, various yarns adjusted to have an elongation rate of 12.5% or more can be used. It is preferable that the elongation rate be 12.5% or more and 300% or less. For example, a yarn containing an elastic fiber and adjusted to have an elongation rate within the aforementioned range can be used. As the elastic fiber, a polyurethane elastic fiber can be used. Further, as the first knitting yarn, a crimped yarn having high elasticity such as a woolly nylon yarn also can be used. In this description, the elastic fiber means a fiber having an elongation rate, as measured according to the aforementioned method, of 50% or more.

The first knitting yarn may be a composite yarn that has a core material containing an elastic fiber, and a coating layer formed by winding a coating fiber around the outer circumference of the core material. As the core material, a polyurethane elastic fiber can be used. As the coating fiber, existing fibers such as a polyethylene fiber, a nylon fiber, a polyester fiber, an aramid fiber, an ultrahigh molecular weight polyethylene fiber, an acrylic fiber, a cotton, and a wool can be used. The use of a long fiber of an organic fiber as a fiber for forming at least the outermost layer of the coating layer can make the first knitting yarn bulky, and therefore the internal texture of the glove is improved. Thus, the aforementioned knitted glove has excellent comfort in wearing.

The aforementioned composite yarn may be a single covered yarn formed by winding a single coating fiber around the outer circumference of the core material in one direction or may be a double covered yarn formed by winding two coating fibers around the outer circumference of the core material in the opposite directions to each other. In the single covered yarn, the coating fiber is wound in one direction, and therefore it tends to be twisted and curled. In contrast, in the double covered yarn, the coating fibers are wound in the opposite directions to each other, and therefore it is less likely to be twisted and curled. Therefore, the double covered yarn is preferably used for the aforementioned composite yarn. Further, the elasticity may be imparted to the composite yarn by winding the coating fibers around the outer circumference of the core material, while the core material is stretched. The draft ratio is preferably 1.5 or more, more preferably 2.0 or more. Thus, the first knitting yarn has higher elasticity, and therefore the shrinkage of the first cross element increases the thickness of the knitted glove, and the cut resistance of the knitted glove is improved. Further, the first knitting yarn with higher elasticity improves the flexibility of the knitted glove.

The first knitting yarn may be a yarn that combines a yarn containing an elastic fiber and a yarn having a lower elongation rate than the aforementioned yarn and is adjusted to have an elongation rate of 12.5% or more and 300% or less as a whole. For enhancing the flexibility, wearing comfort, and cut resistance of the knitted glove, the elongation rate of the first knitting yarn is preferably 15% or more, more preferably 25% or more. As the yarn having a lower elongation rate than the yarn containing an elastic fiber, a yarn containing a nylon fiber, a polyester fiber, or a cut resistant fiber, for example, can be used. The nylon fiber and the polyester fiber may be crimped. As the cut resistant fiber, a metal fiber such as a copper fiber, an iron fiber, an aluminum fiber, and a stainless steel fiber, a glass fiber, an aramid fiber, an ultrahigh molecular weight polyethylene fiber, and a polyparaphenylene benzobisoxazole fiber, for example, can be used.

In the case of using the thus combined yarn for the first knitting yarn, the first loops may be formed in a plated state or aligned state. It is preferable to form the first loops in a plated state since the yarn containing an elastic fiber can be exposed to the inside of the glove, and the yarn having a lower elasticity than the yarn containing an elastic fiber can be exposed to the outside of the glove.

As the second knitting yarn for knitting the second course, a yarn containing a cut resistant fiber can be used. As the cut resistant fiber, a metal fiber such as a stainless steel fiber (with a tensile strength of about 2600 N/mm$^2$), a glass fiber with a tensile strength of 1800 to 4000 N/mm$^2$, an aramid fiber (such as Kevlar (registered trademark) manufactured by DuPont (with a tensile strength of about 2900 N/mm$^2$)), an ultrahigh molecular weight polyethylene fiber (such as Tsunooga (registered trademark) manufactured by TOYOBO CO., LTD. (with a tensile strength of about 2000 N/mm$^2$) and Dyneema (registered trademark) manufactured by TOYOBO CO., LTD. (with a tensile strength of about 4200 N/mm$^2$)), and a polyparaphenylene benzobisoxazole fiber (such as ZYLON (registered trademark) manufactured by TOYOBO CO., LTD. (with a tensile strength of about 5800 N/mm$^2$)), for example, can be used. It is more preferable that the second knitting yarn contain a cut resistant fiber having a tensile strength of 1600 N/mm$^2$ or more. The various cut resistant fibers can be used in the form of a single fiber, a fiber bundle, a sliver, or a composite yarn. Further, the type and amount of the yarn can be adjusted, depending on the required cut resistance performance.

The second knitting yarn may be a composite yarn that has a core material containing a cut resistant fiber, and a coating layer formed by winding a coating fiber around the outer circumference of the core material. In particular, in the case of using a metal fiber or a glass fiber, this form is preferably taken in order to reduce the exposure of such a fiber from the composite yarn. As the core material, a filament of a metal fiber can be used. As the coating fiber, the same fiber as described for the first knitting yarn can be used. The use of a long fiber of an organic fiber as the fiber for forming at least the outermost layer of the coating layer can suppress the deterioration in the internal texture of the glove felt by the wearer when the cut resistant fiber directly touches the hand. Thus, the aforementioned knitted glove has excellent comfort in wearing. An additional yarn may be combined with the aforementioned core material. The use of the additional yarn can suppress the core material from being cut when winding the coating fiber around the outer circumference of the core material. As the additional yarn, an ultrahigh molecular weight polyethylene fiber, a liquid crystal polyester fiber, and a high strength polyarylate fiber, and filaments of a polyethylene fiber, a polyester fiber, an aramid fiber, and a polyarylate fiber, for example, can be used. Among these, an ultrahigh molecular weight polyethylene fiber, a polyester fiber, and an aramid fiber are preferably used. Long fibers of these fibers are preferably used.

The aforementioned composite yarn may be a single covered yarn or may be a double covered yarn. It is preferable to use a double covered yarn as the aforementioned composite yarn since the double covered yarn is less likely to be twisted and curled.

As long as the cut resistance of the second knitting yarn can be maintained, any yarn may be combined with the yarn containing a cut resistant fiber. For example, in order to improve the texture, a yarn containing a fiber with softer texture than the cut resistant fiber may be combined. As the yarn containing a fiber with softer texture than the cut resistant fiber, a yarn containing a nylon fiber, a polyester fiber, a cotton, or an elastic fiber can be used. The nylon fiber and the polyester fiber may be crimped. In the aforementioned case, the cut resistance of the second knitting yarn tends to depend on the type and use amount of the cut resistant fiber. The type and use amount of the cut resistant fiber are appropriately determined according to the purpose.

In the case of using the thus combined yarn for the second knitting yarn, the second loops may be formed in a plated state or aligned state. It is preferable to form the second loops in a plated state since the yarn containing a cut resistant fiber can be exposed to the outside of the glove, and the yarn having a lower tensile strength than the aforementioned yarn can be exposed to the inside of the glove.

The aforementioned knitted fabric is at least partially contained in the knitted glove. Specifically, the knitted fabric is at least partially contained in a pinky finger stall, a ring finger stall, a middle finger stall, an index finger stall, a thumb finger stall, a three-body part, a four-body part, a five-body part, and a wrist part. For allowing the entire knitted glove to exert the effects of the present invention, it is preferable that the aforementioned knitted fabric be contained in all of the finger stalls, the body parts, and the wrist part, and it is more preferable that all of the finger stalls, the body parts, and the wrist part be formed using the aforementioned knitted fabric.

A specific example of the knitted fabric contained in the knitted glove of the present invention will be described below with reference to FIG. 1 to FIG. 4. FIG. 1 to FIG. 4 show only a part of the configuration of a knitted fabric 100. In FIG. 1 to FIG. 4, X represents the course direction, and Y represents the wale direction.

First Embodiment

As shown in FIG. 1, in the knitted fabric 100 according to the first embodiment of the present invention, first loops 11 in multiple stages of a first course 31 shown by the solid lines are provided continuously with one another in the wale direction (Y), and second loops 12 in multiple stages of a second course 32 shown by the dashed lines are provided continuously with one another in the wale direction (Y).

In the knitted fabric, two adjacent first loops 11 in each stage of the first course 31 are connected to each other by a first cross element 21, and each two adjacent second loops 12 in each stage of the second course 32 are connected to each other by a second cross element 22. Further, each second loop 12 in the N+1-th stage of the second course 32 is arranged between every two adjacent first loops 11 in the N-th (N is an integer of 1 or more, which also applies to the following description) stage of the first course 31, each first loop 11 in the N+2-th stage of the first course 31 is arranged between every two adjacent second loops 12 in the N+1-th stage of the second course 32, and each second loop 12 in the N+3-th stage of the second course 32 is arranged between every two adjacent first loops 11 in the N+2-th stage of the first course 31. Then, the second cross element 22 in the N+1-th stage of the second course 32 crosses over one first loop 11 in the N-th stage of the first course 31, the first cross element 21 in the N+2-th stage of the first course 31 crosses over one second loop 12 in the N+1-th stage of the second course 32, and the second cross element 22 in the N+3-th stage of the second course 32 crosses over the first loop 11 in the N+2-th stage of the first course 31.

In the knitted fabric 100 of this embodiment, the first cross element 21 stretches and shrinks in the course direction, and therefore the thickness can be increased, that is, the cut resistance can be increased, and the flexibility in the course direction can be increased. Further, the first loops 11 stretch and shrink in the course direction and the wale direction, and therefore the flexibility in the course direction and the wale direction can be increased. Further, the first cross element 21 stretches and shrinks in the course direction, and the first loops 11 stretch and shrink in the course direction and the wale direction, thereby improving the comfort when worn. Further, the second loops 12 and the second cross element 22 are formed using a yarn containing cut resistant fiber, and therefore the cut resistance can be increased. Thus, the knitted fabric 100 of this embodiment is comparatively excellent in cut resistance, flexibility, and comfort in wearing.

Second embodiment

Figure 2:
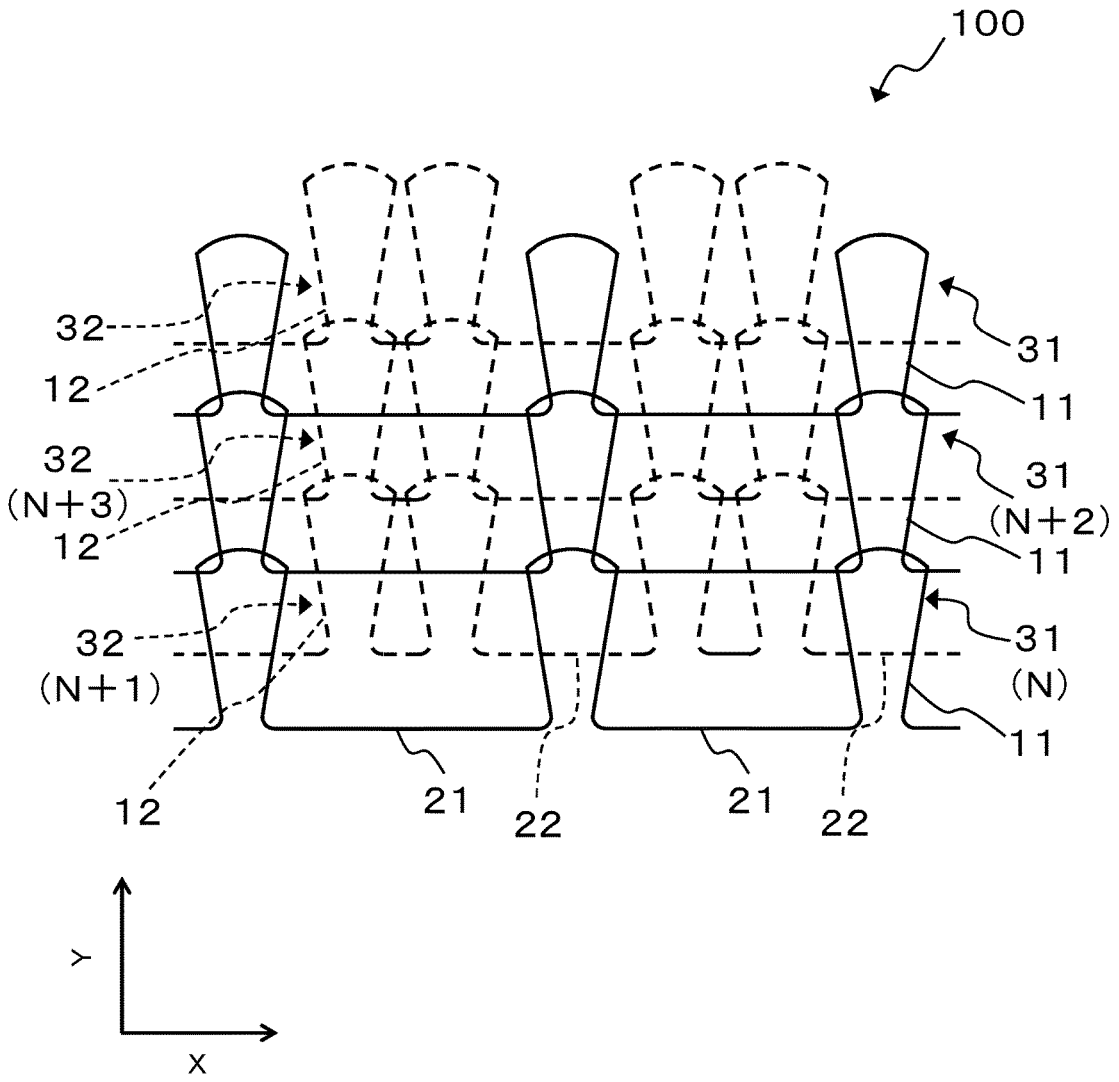
FIG. 2 is a view showing a knitted fabric contained in a knitted glove according to a second embodiment of the present invention.

As shown in FIG. 2, the knitted fabric 100 according to the second embodiment of the present invention is different from the knitted fabric 100 according to the first embodiment in that two second loops 12 in the N+1-th stage of the second course 32 are arranged between every two adjacent first loops 11 in the N-th stage of the first course 31, and two second loops 12 in the N+3-th stage of the second course 32 are arranged between every two first loops 11 in the N+2-th stage of the first course 31.

Further, it is different from the knitted fabric 100 according to the first embodiment also in that the first cross element 21 in the N+2-th stage of the first course 31 crosses over the two second loops 12 in the N+1-th stage of the second course 32. In this embodiment, the first cross element 21 crosses over the two second loops 12, and therefore the first cross element 21 of this embodiment has a larger length than the first cross element 21 of the first embodiment.

In the knitted fabric 100 of this embodiment, the first cross element 21 has a larger length than the first cross element 21 of the first embodiment, and therefore the distance that the first cross element 21 can shrink is increased, as compared with the knitted fabric 100 of the first embodiment. Therefore, the thickness of the knitted fabric 100 is increased. Thus, the cut resistance of the knitted fabric 100 of this embodiment is more improved, as compared with the knitted fabric 100 of the first embodiment. Further, the distance that the first cross element 21 can shrink is increased, and therefore the flexibility in the circumferential direction of the palm is improved, as compared with the knitted fabric 100 of the first embodiment.

Third embodiment

Figure 3:
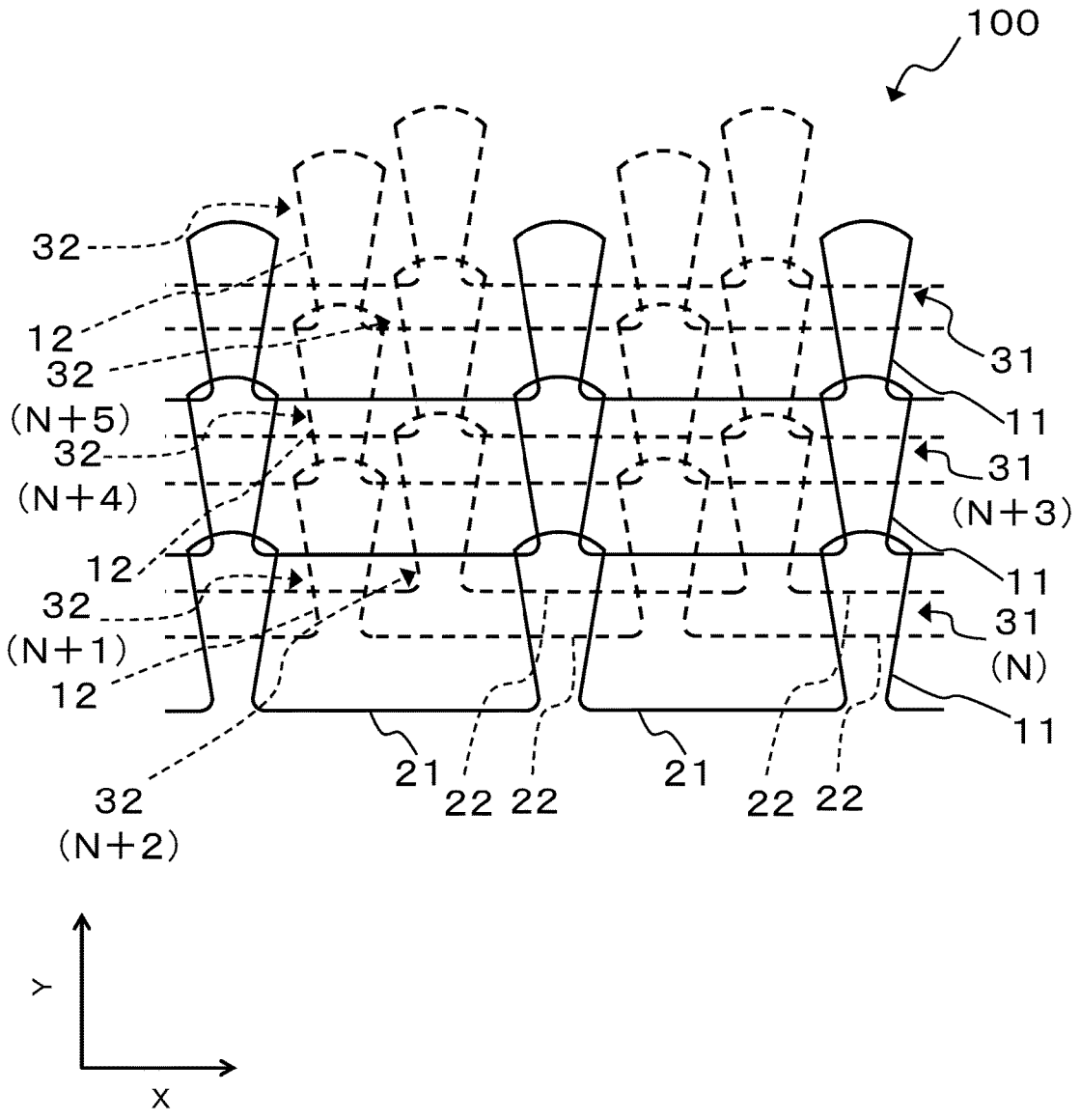
FIG. 3 is a view showing a knitted fabric contained in a knitted glove according to a third embodiment of the present invention.

As shown in FIG. 3, the knitted fabric 100 according to the third embodiment of the present invention is different from the knitted fabric 100 according to the second embodiment in that one second loop 12 in the N+1-th stage and one second loop 12 in the N+2-th stage are arranged between every two adjacent first loops 11 in the N-th stage of the first course 31, one second loop 12 in the N+2-th stage and one first loop 11 in the N+3-th stage of the first course 31 are arranged between every two adjacent second loops 12 in the N+1-th stage of the second course 32, one first loop 11 in the N+3-th stage of the first course 31 and one second loop 12 in the N+4-th stage of the second course 32 are arranged between every two adjacent second loops 12 in the N+2-th stage of the second course 32, and one second loop 12 in the N+4-th stage and one second loop 12 in the N+5-th stage of the second course 32 are arranged between every two adjacent first loops 11 in the N+3-th stage of the first course 31.

Further, the knitted fabric 100 according to the third embodiment is different from the knitted fabric 100 according to the second embodiment also in that the second cross element 22 in the N+2-th stage of the second course 32 crosses over one first loop 11 in the N-th stage of the first course 31 and one second loop 12 in the N+1-th stage of the second course 32, the first cross element 21 in the N+3-th stage of the first course 31 crosses over one second loop 12 in the N+1-th stage of the second course 32 and one second loop 12 in the N+2-th stage of the second course 32, the second cross element 22 in the N+4-th stage of the second course 32 crosses over one second loop 12 in the N+2-th stage of the second course 32 and one first loop 11 in the N+3-th stage of the first course 31, and the second cross element 22 in the N+5-th stage of the second course 32 crosses over one first loop 11 in the N+3-th stage of the first course 31 and one second loop 12 in the N+4-th stage of the second course 32.

In the knitted fabric 100 of this embodiment, the first cross element 21 has a larger length than the first cross element 21 of the first embodiment, and therefore the distance that the first cross element 21 can shrink is increased, as compared with the knitted fabric 100 of the first embodiment. Therefore, the thickness of the knitted fabric 100 is increased. Thus, the cut resistance of the knitted fabric 100 of this embodiment is more improved, as compared with the knitted fabric 100 of the first embodiment. Further, the distance that the first cross element 21 can shrink is increased, and therefore the flexibility in the circumferential direction of the palm is improved, as compared with the knitted fabric 100 of the first embodiment. Further, the frequency that the second cross element 22 crosses over the loops is increased as compared with that in the knitted fabric 100 of the second embodiment, and therefore the cut resistance is more improved.

Fourth embodiment

Figure 4:
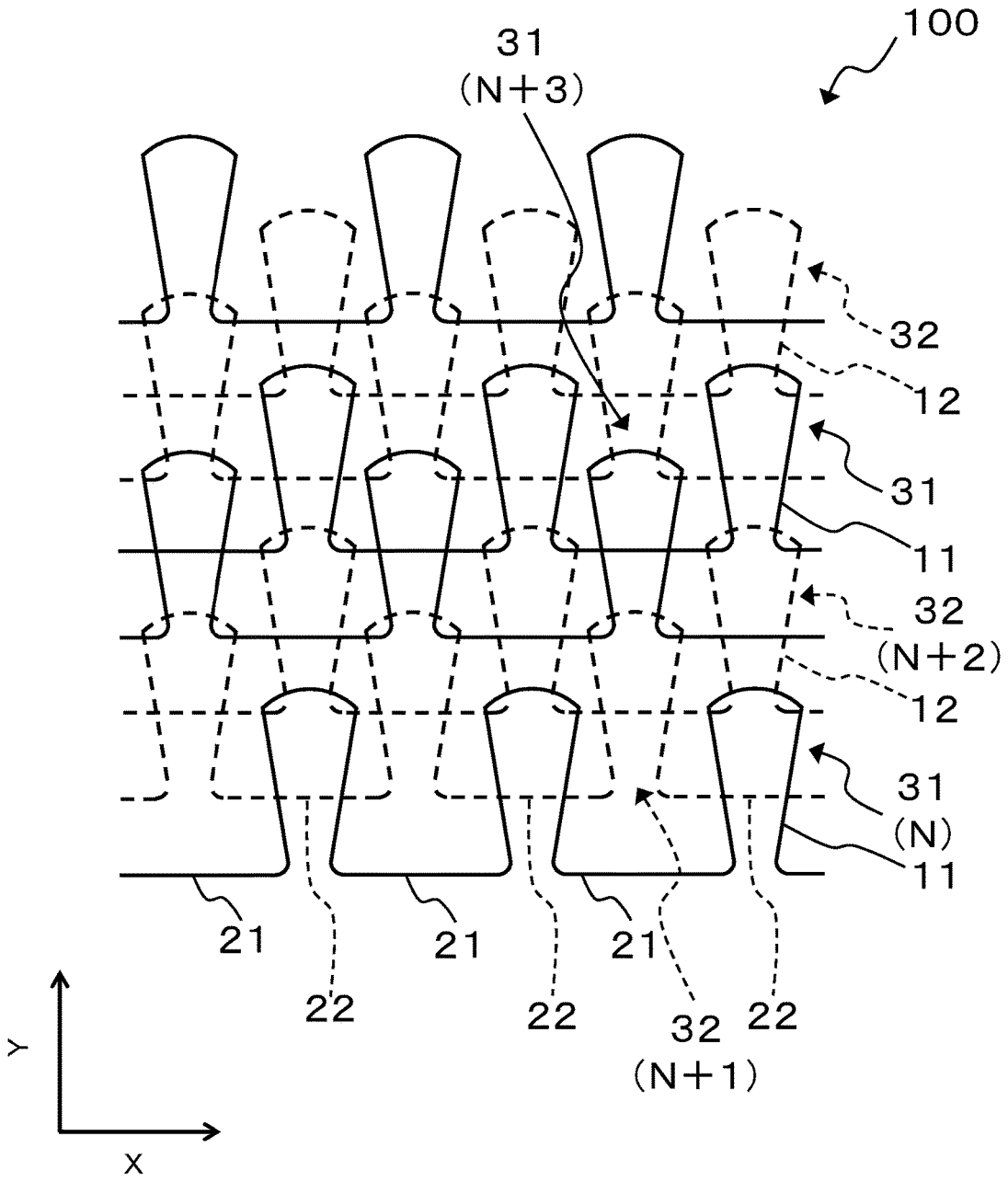
FIG. 4 is a view showing a knitted fabric contained in a knitted glove according to a fourth embodiment of the present invention.

As shown in FIG. 4, the knitted fabric 100 according to the fourth embodiment of the present invention is different from the knitted fabric 100 according to the first embodiment in that the first loops 11 of the first course 31 and the second loops 12 of the second course 32 are alternately and continuously provided in the wale direction (Y).

Specifically, the knitted fabric 100 according to the fourth embodiment is different from the knitted fabric 100 according to the first embodiment in that the first loops 11 in the N-th stage of the first course 31 and the second loops 12 in the N+2-th stage of the second course 32 are provided in this order continuously with each other in the wale direction (Y), and the second loops 12 in the N+1-th stage of the second course 32 and the first loops 11 in the N+3-th stage of the first course 31 are provided in this order continuously with each other in the wale direction (Y).

Further, the knitted fabric 100 according to the fourth embodiment is different from the knitted fabric 100 according to the first embodiment also in that the second cross element 22 in the N+1-th stage of the second course 32 crosses over one first loop 11 in the N-th stage of the first course 31, the second cross element 22 in the N+2-th stage of the second course 32 crosses over one second loop 12 in the N+1-th stage of the second course 32, and the first cross element 21 in the N+3-th stage of the first course 31 crosses over one second loop 12 in the N+2-th stage of the second course 32.

In the knitted fabric 100 of the first embodiment, the stages in which the first cross element 21 is present and the stages in which the first cross element 21 is not present are alternately arranged in the stages of the loops that are provided continuously with one another in the wale direction. In contrast, in the knitted fabric 100 of this embodiment, the first loops 11 and the second loops 12 are alternately provided continuously with each other in the wale direction, and therefore the first cross element 21 is present in every stage of the loops provided continuously with one another in the wale direction. Thus, the first cross element 21 shrinks in every stage, and therefore the thickness of the knitted fabric 100 is more increased than in the knitted fabric 100 of the first embodiment. Thus, the cut resistance of the knitted fabric 100 of this embodiment is more improved, as compared with the knitted fabric 100 of the first embodiment.

Next, a method for producing the knitted fabric 100 contained in the knitted glove of the present invention will be described.

The method for producing the knitted fabric 100 contained in the knitted glove of the present invention includes: a plurality of first course knitting steps of knitting a first course using a first knitting yarn by aligning a plurality of first loops in the course direction so as to be connected to each other by each first cross element; and a plurality of second course knitting steps of knitting a second course using a second knitting yarn by aligning a plurality of second loops in the course direction, wherein at least one of the plurality of first course knitting steps is a step of knitting the first course so that the first cross element crosses over a loop in another stage of the courses, wherein the first knitting yarn constituting the first course has an elongation rate of 12.5% or more, and the second knitting yarn constituting the second course includes a yarn containing a cut resistant fiber.

In the aforementioned method for producing a knitted fabric contained in the knitted glove, using a flat knitting machine including needle beds having knitting needles provided side by side in a direction in which the courses of the knitted fabric extend, a first yarn feeder configured to feed the first knitting yarn to knitting needles, and a second yarn feeder configured to feed the second knitting yarn to knitting needles, at least one of the first course knitting steps may be forming the first cross element so as to cross over a loop formed by the knitting needle that has not been used above in the first course knitting step among the loops in the course knitted in the one-step-ahead course knitting step by feeding the first knitting yarn from the first yarn feeder to a knitting needle in the needle beds without using a knitting needle that has been used in a course knitting step ahead of the first course knitting step. In the aforementioned embodiment, all of the knitting needles used in the course knitting step ahead of the first course knitting step are not necessarily unused in the first course knitting step. The knitting needles need only to be at least partially unused. It is preferable not to use 80% or more of the knitting needles, more preferably 90% or more of them, further preferably all of them.

In the aforementioned method for producing a knitted fabric, at least one of the second course knitting steps may be forming the second cross element so as to cross over a loop formed by the knitting needle that has not been used above in the second course knitting step among the loops in the course knitted in the one-step-ahead course knitting step by feeding the second knitting yarn from the second yarn feeder to a knitting needle in the needle beds without using a knitting needle that has been used in a course knitting step ahead of the second course knitting step. In the aforementioned embodiment, all of the knitting needles used in the course knitting step ahead of the second course knitting step are not necessarily unused. The knitting needles need only to be at least partially unused. It is preferable not to use 80% or more of the knitting needles, more preferably 90% or more of them, further preferably all of them.

In the aforementioned method for producing a knitted fabric, the first course knitting steps may be performed with a tension of 50 mN applied to the first knitting yarn.

Hereinafter, a method for producing the knitted fabric 100 according to the aforementioned first to fourth embodiments using a flat knitting machine 200 of an example shown in FIG. 5 will be described.

Figure 5:
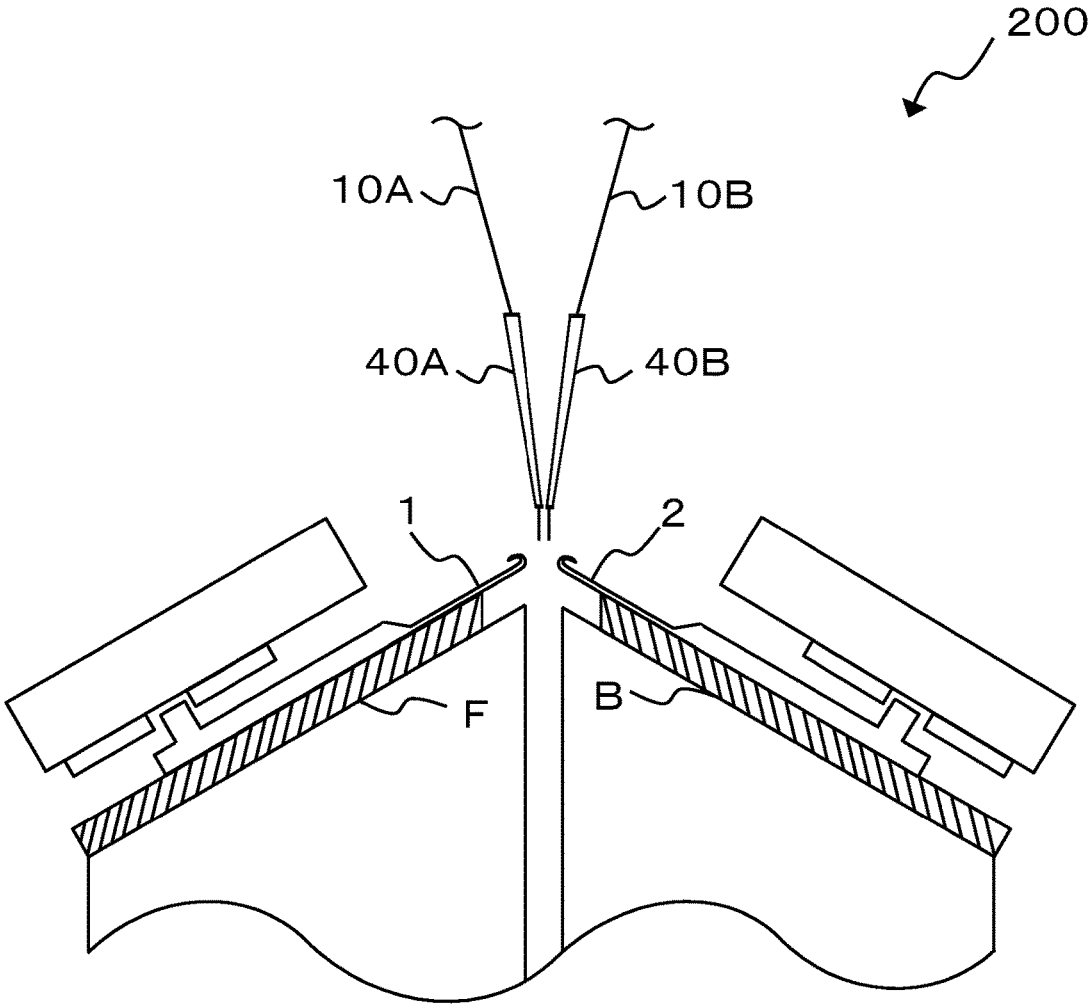
FIG. 5 is a schematic view of an example of a flat knitting machine used for producing the knitted fabric contained in the knitted glove according to each embodiment of the present invention.
Figure 6A:
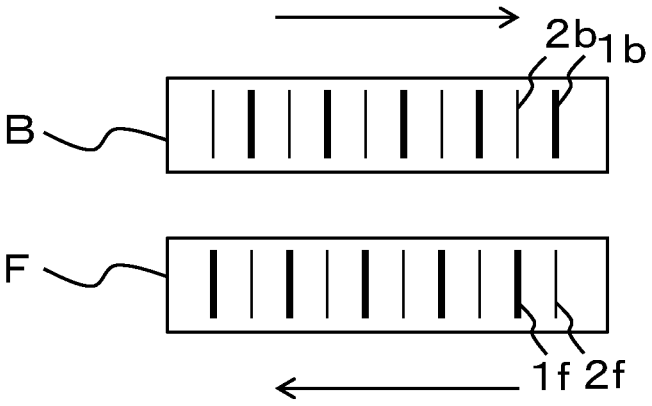
FIG. 6A is a view showing the arrangement of knitting needles in needle beds for producing the knitted fabric contained in the knitted glove according to the first embodiment of the present invention.

The flat knitting machine 200 shown in FIG. 5 includes: a pair of needle beds F and B in which knitting needles 1 and 2 are provided side by side; a first yarn feeder 40A configured to feed a first knitting yarn 10A to the knitting needles 1 or 2; a second yarn feeder 40B configured to feed a second knitting yarn 10B to the knitting needles 1 or 2. More specifically, in both of the needle beds F and B of the flat knitting machine 200, the knitting needles 1 (knitting needles if in the needle bed F and knitting needles 1*b* in the needle bed B) and the knitting needles 2 (knitting needles 2*f* in the needle bed F and knitting needles 2*b* in the needle bed B) are alternately provided side by side, for example, as shown in FIG. 6A.

The knitting needles 1 and 2 are arranged on the needle beds F and B so as to be movable upwardly and downwardly. In the case of forming the first loops using the knitting needles 1, the first knitting yarn 10A is fed from the first yarn feeder 40A to the knitting needles 1 when the knitting needles 1 are moved upwardly to a predetermined position, and the first loops are formed by moving the knitting needles 1 to which the first knitting yarn 10A is fed downwardly. Further, in the case of forming the second loops using the knitting needles 2, the second loops are formed in the same manner as in the case of forming the first loops using the knitting needles 1 except that the second knitting yarn 10B is fed from the second yarn feeder 40B to the knitting needles 2. The knitted fabric 100 is produced by continuously providing the first loops and the second loops formed as above in the course direction and the wale direction.

First embodiment

Figure 6B:
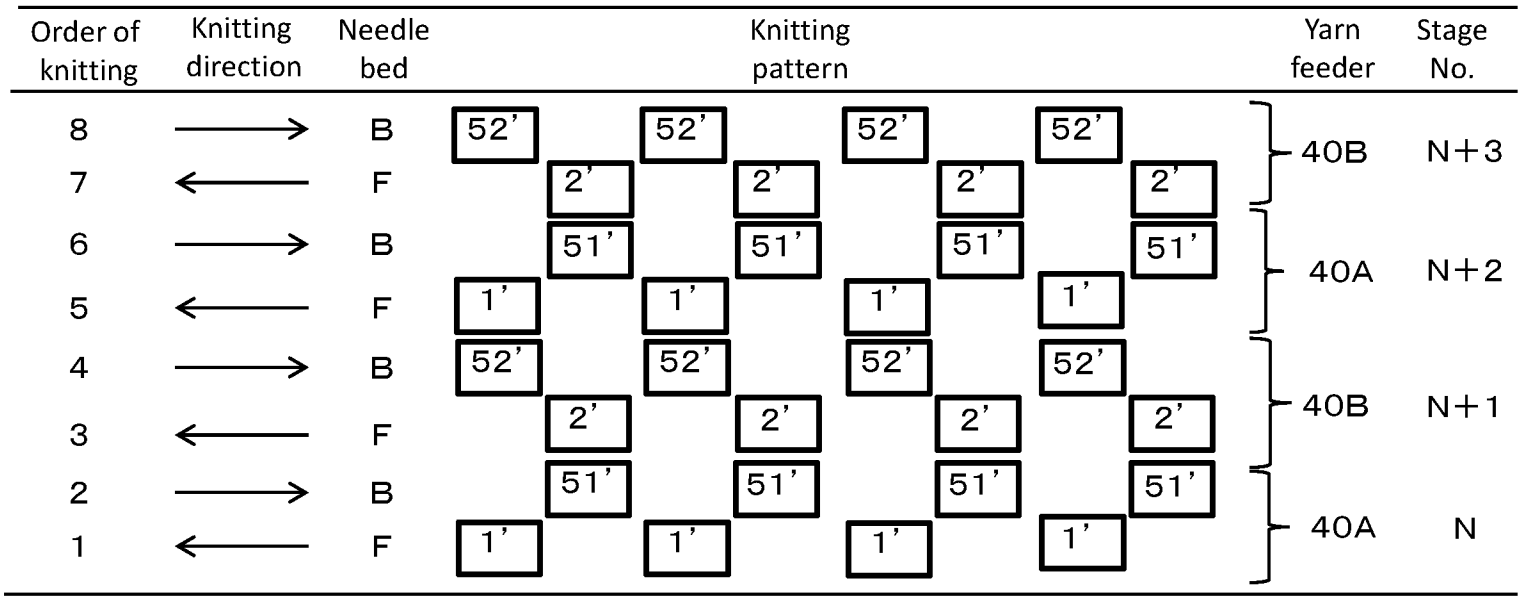
FIG. 6B is a formation diagram used for producing the knitted fabric contained in the knitted glove according to the first embodiment of the present invention.

A method for producing the knitted fabric 100 according to the first embodiment will be described with reference to FIGS. 6A and 6B. In FIGS. 6A and 6B, F represents a front needle bed, and B represents a rear needle bed. The same applies to the following FIG. 7A to FIG. 9B.

In FIG. 6A, lines if (thick lines in the Figure) represent knitting needles which are provided in the front needle bed F and to which the first knitting yarn 10A is fed, and lines 2*f* (fine lines in the Figure) represent knitting needles which are provided in the front needle bed F and to which the second knitting yarn 10B is fed. Further, lines 1*b* (thick lines in the Figure) represent knitting needles which are provided in the rear needle bed B and to which the first knitting yarn 10A is fed, and lines 2*b* (fine lines in the Figure) represent knitting needles which are provided in the rear needle bed B and to which the second knitting yarn 10B is fed. As shown in FIG. 6A, the knitting needles if and the knitting needles 1*b* are arranged at every other stitch in this embodiment. One knitting needle 2*f* is arranged between two adjacent knitting needles 1*f*, and one knitting needle 2*b* is arranged between two adjacent knitting needles 1*b*. The number of knitting needles shown in FIG. 6A is smaller than the number of knitting needles that are actually provided in the needle beds F and B, for convenience of description.

In FIG. 6B, "Order of knitting" indicates the order of forming loops in the course direction, "Knitting direction" indicates the course direction in which the first knitting yarn 10A or the second knitting yarn 10B is fed, that is, the course direction in which the first yarn feeder 40A or the second yarn feeder 40B is moved, "Needle bed" indicates the needle bed used in each order of knitting, "Knitting pattern" indicates the loops formed in the order of knitting, "Yarn feeder" indicates the yarn feeder used in the order of knitting, and "Stage No." indicates the stage number in which the loops are provided continuously in the wale direction. Further, in the knitting pattern shown in FIG. 6B, 1' and 51' mean that the first loops are formed in the order of knitting, and 2' and 52' mean that the second loops are formed in the order of knitting. The same applies to the following FIG. 7B, FIG. 8B, and FIG. 9B. In this embodiment, the knitting needles if are used for forming the first loops in 1', the knitting needles 2*f* are used for forming the first loops in 51', the knitting needles 1*b* are used for forming the second loops in 2', and the knitting needles 2*b* are used for forming the second loops in 52'.

In this embodiment, the knitted fabric 100 is produced as follows. (1) The first knitting yarn 10A is fed from the first yarn feeder 40A holding the first knitting yarn 10A only to the knitting needles 1*f*, that is, the first knitting yarn 10A is fed at every other stitch to the knitting needles 1 and 2 provided side by side in one of the directions in which the knitting needles 1 and 2 are provided side by side (to the left in FIG. 6A), and the first loops are formed at the positions of the knitting needles 1*f*, to form a first cross element between the knitting needles 1*f*, that is, to form a first cross element that occupies a region corresponding to one knitting needle. Next, the first knitting yarn 10A is fed from the first yarn feeder 40A only to the knitting needles 1*b*, that is, the first knitting yarn 10A is fed at every other stitch to the knitting needles 1*b* in the other of the directions (to the right in FIG. 6A), and the first loops are formed at the positions of the knitting needles 1*b*, to form a first cross element between the knitting needles 1*b*, that is, to form a first cross element that occupies a region corresponding to one knitting needle. Thus, the N-th stage of the first course including the first loops and the first cross element configured to connect the first loops to each other is knitted (step of knitting the N-th stage of the first course). (2) Next, the second knitting yarn 10B is fed from the second yarn feeder 40B holding the second knitting yarn 10B only to the knitting needles 2*f* that have been skipped in the step of knitting the N-th stage of the first course in one of the directions so as to cross over the first loops in the N-th stage of the first course, and the second loops are formed at the positions of the knitting needles 2*f*, to form a second cross element between the knitting needles 2*f*. Next, the second knitting yarn 10B is fed from the second yarn feeder 40B only to the knitting needles 2*b* that have been skipped in the step of knitting the N-th stage of the first course in the other of the directions so as to cross over the first loops in the N-th stage of the first course, and the second loops are formed at the positions of the knitting needles 2*b*, to form a second cross element between the knitting needles 2*b*. Thus, the N+1-th stage of the second course including the second loops and the second cross element connecting the second loops to each other and crossing over the first loops in the N-th stage is knitted (step of knitting the N+1-th stage of the second course). (3) Next, the first knitting yarn 10A is fed from the first yarn feeder 40A to the knitting needles if in one of the directions so as to cross over the second loops in the N+1-th stage of the second course, and the first loops provided continuously with the first loops in the N-th stage are formed at the positions of the knitting needles 1*f*, to form a first cross element between the knitting needles 1*f*. Next, the first knitting yarn 10A is fed from the first yarn feeder 40A to the knitting needles 1*b* in the other of the directions so as to cross over the second loops in the N+1-th stage of the second course, the first loops provided continuously with the first loops in the N-th stage are formed at the positions of the knitting needles 1*b*, to form a first cross element between the knitting needles 1*b*. Thus, the N+2-th stage of the first course including the first loops and the first cross element connecting the first loops to each other and crossing over the second loops in the N+1-th stage of the second course is knitted (step of knitting the N+2-th stage of the first course). (4) Next, the second knitting yarn 10B is fed from the second yarn feeder 40B to the knitting needles 2*f* in one of the directions so as to cross over the first loops in the N+2-th stage of the first course, and the second loops provided continuously with the second loops in the N+1-th stage are formed at the positions of the knitting needles 2*f*, to form a second cross element between the knitting needles 2*f*. Next, the second knitting yarn 10B is fed from the second yarn feeder 40B to the knitting needles 2*b* in the other of the directions so as to cross over the first loops in the N+2-th stage of the first course, and the second loops provided continuously with the second loops in the N+1-th stage are formed at the positions of the knitting needles 2*b*, to form a second cross element between the knitting needles 2*b*. Thus, the N+3-th stage of the second course including the second loops and the second cross element connecting the second loops to each other and crossing over the first loops in the N+2-th stage of the first course is knitted (step of knitting the N+3-th stage of the second course). (5) The loops are provided continuously in the wale direction by alternately repeating steps (3) and (4) described above. As described above, the knitted fabric 100 according to the first embodiment is produced.

Second embodiment

Figure 7A:
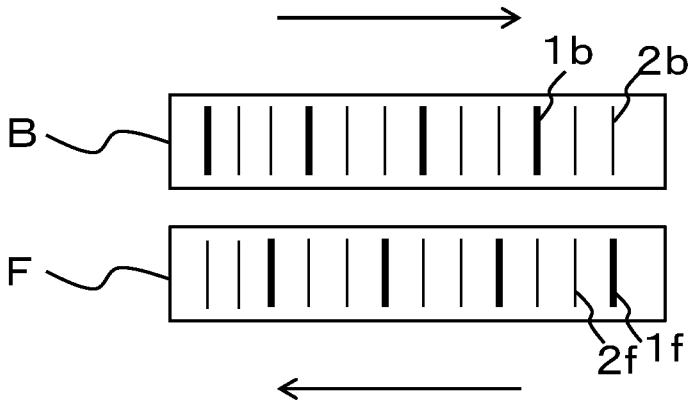
FIG. 7A is a view showing the arrangement of knitting needles in needle beds for producing the knitted fabric contained in the knitted glove according to the second embodiment of the present invention.
Figure 7B:
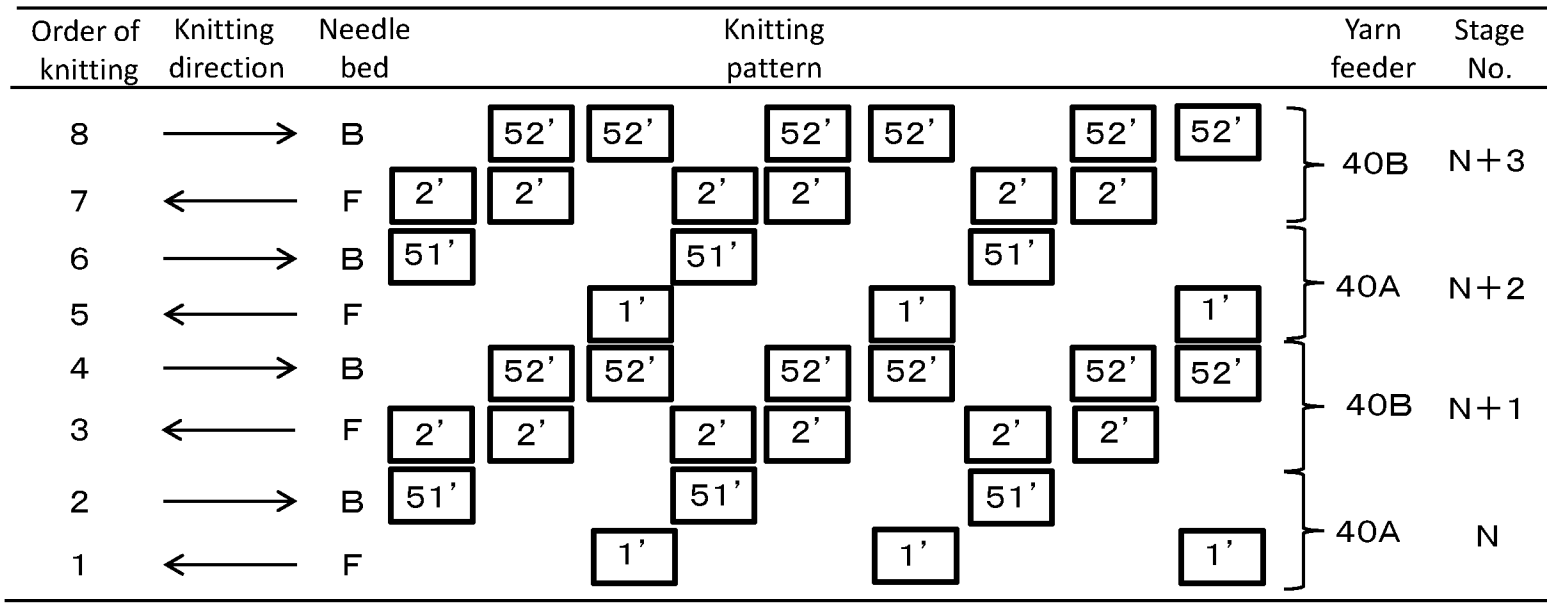
FIG. 7B is a formation diagram used for producing the knitted fabric contained in the knitted glove according to the second embodiment of the present invention.

Next, a method for producing the knitted fabric 100 according to the second embodiment will be described with reference to FIGS. 7A and 7B. As shown in FIG. 7A, in this embodiment, the knitting needles if and the knitting needles 1*b* are arranged at every two stitches, two knitting needles 2*f* are arranged between the knitting needles 1*f*, and two knitting needles 2*b* are arranged between the knitting needles 1*b*. Further, also in this embodiment, the same knitting needles as used in the method for producing a knitted fabric according to the first embodiment are used for forming the loops in 1', 2', 51', and 52' of the knitting pattern shown in FIG. 7B. Also in FIG. 7A, the number of knitting needles is smaller than the number of knitting needles that are actually provided in the needle beds F and B.

In this embodiment, the knitted fabric 100 is produced as follows. (1) The N-th stage of the first course including the first loops and the first cross element that occupies a region corresponding to two knitting needles is knitted in the same manner as in step (1) of the first embodiment except that the first knitting yarn 10A is fed at every two stitches to the knitting needles if and 1*b* (step of knitting the N-th stage of the first course). (2) Next, the second knitting yarn 10B is fed from the second yarn feeder 40B holding the second knitting yarn 10B only to the two knitting needles 2*f* that have been skipped in the step of knitting the N-th stage of the first course in one of the directions (the left direction in FIG. 7A), so as to cross over the first loops in the N-th stage of the first course, and the second loops are formed at the positions of the knitting needles 2*f*, to form a second cross element between the knitting needles 2*f* provided with a spacing corresponding to the length of one knitting needle. Next, the second knitting yarn 10B is fed from the second yarn feeder 40B only to the two knitting needles 2*b* that have been skipped in the aforementioned step in the other of the directions (to the right in FIG. 7A), so as to cross over the first loops in the N-th stage of the first course, and the second loops are formed at the positions of the knitting needles 2*b*, to form a second cross element between the knitting needles 2*b* provided with a spacing corresponding to the length of one knitting needle. Thus, the N+1-th stage of the second course including the second loops and the second cross element connecting the second loops to each other and crossing over the first loops in the N-th stage is knitted (step of knitting the N+1-th stage of the second course). (3) The N+2-th stage of the first course including the first loops and the first cross element connecting the first loops to each other and crossing over the second loops in the N+1-th stage of the second course is knitted in the same manner as in step (3) of the first embodiment except that the first knitting yarn 10A is fed at every two stitches to the knitting needles if and 1*b* (step of knitting the N+2-th stage of the first course). (4) The N+3-th stage of the second course including the second loops and the second cross element connecting the second loops to each other and crossing over the first loops in the N+2-th stage of the first course is knitted in the same manner as in step (4) of the first embodiment except that the positions where the knitting needles 1*f*, 2*f*, 1*b*, and 2*b* are provided, the positions of the loops and the cross element formed by the knitting needles and the length of the cross element are different (step of knitting the N+3-th stage of the second course). (5) The loops are provided continuously in the wale direction by alternately repeating steps (3) and (4). As described above, the knitted fabric 100 according to the second embodiment is produced.

Third embodiment

Figure 8A:
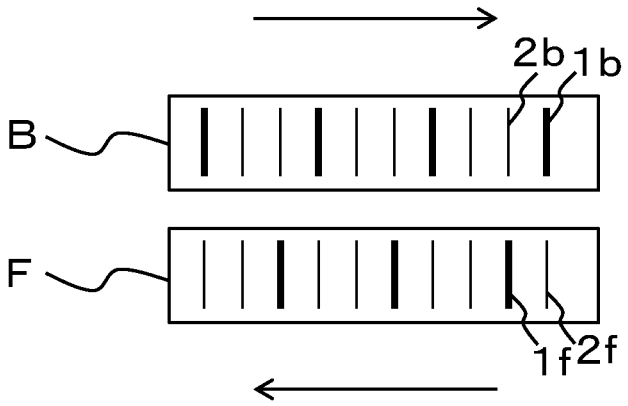
FIG. 8A is a view showing the arrangement of knitting needles in needle beds for producing the knitted fabric contained in the knitted glove according to the third embodiment of the present invention.
Figure 8B:
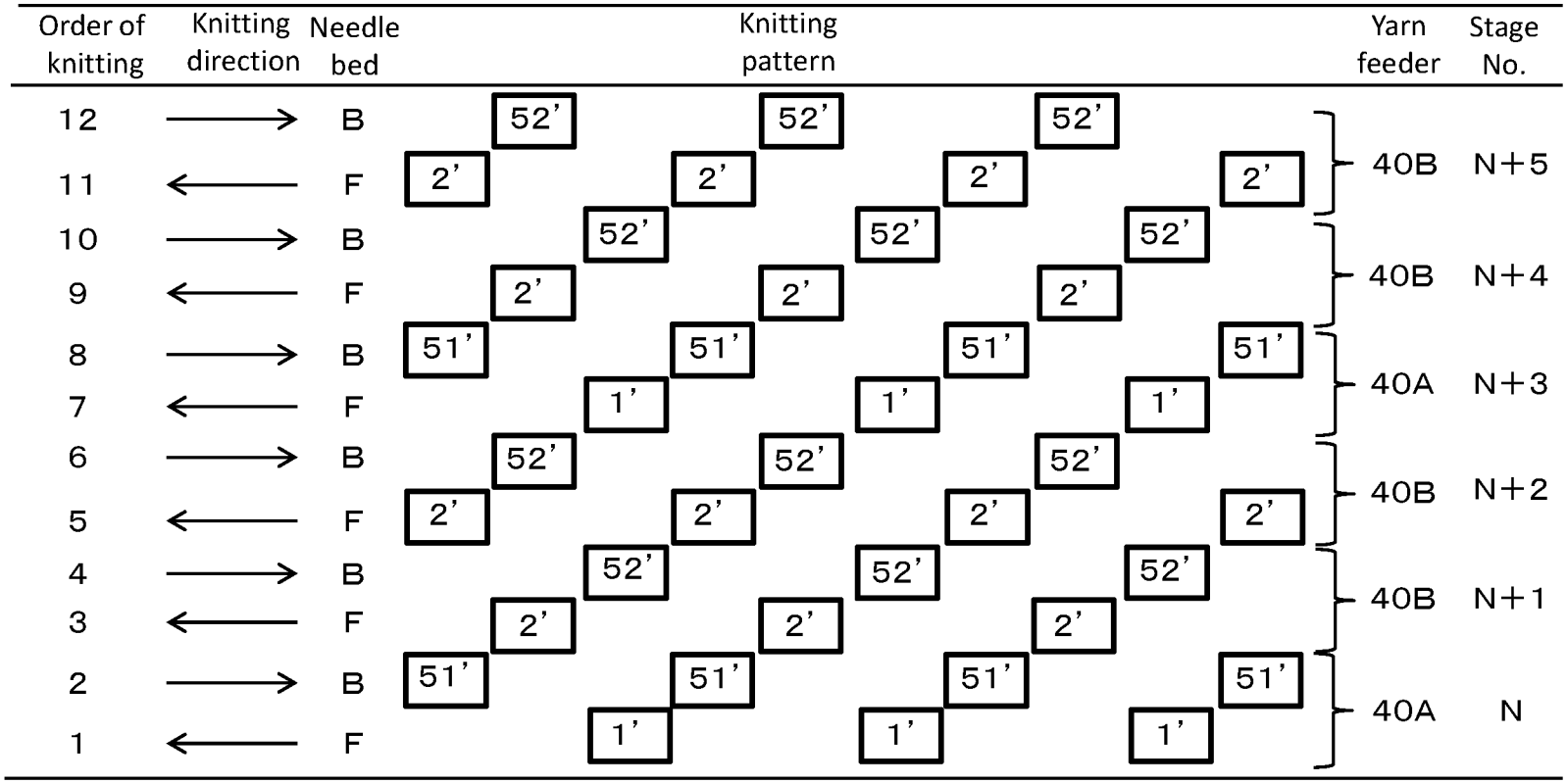
FIG. 8B is a formation diagram used for producing the knitted fabric contained in the knitted glove according to the third embodiment of the present invention.

Next, a method for producing the knitted fabric 100 according to the third embodiment will be described with reference to FIGS. 8A and 8B. In this embodiment, the knitted fabric 100 is produced so that the two loops formed in the same stage of the second course in the second embodiment are respectively formed in other states of the second course. Further, also in this embodiment, the same knitting needles as used in the method for producing a knitted fabric according to the first embodiment are used for forming the loops in 1', 2', 51', and 52' of the knitting pattern in FIG. 8B. Also in FIG. 8A, the number of knitting needles is smaller than the number of knitting needles that are actually provided in the needle beds F and B.

In this embodiment, the knitted fabric 100 is produced as follows. (1) The N-th stage of the first course is knitted in the same manner as in step (1) of the second embodiment (step of knitting the N-th stage of the first course). (2) Next, the second knitting yarn 10B is fed from the second yarn feeder 40B holding the second knitting yarn 10B only to the knitting needles 2*f* on one side adjacent to the knitting needles if in one of the directions (to the left in FIG. 8A), so as to cross over the first loops in the N-th stage of the first course, and the second loops are formed at the positions of the knitting needles 2*f* on one side, to form a second cross element between the knitting needles 2*f* on one side. Next, the second knitting yarn 10B is fed from the second yarn feeder 40B only to the knitting needles 2*b* on one side adjacent to the knitting needles 1*b* in the other of the directions (to the right in FIG. 8A), so as to cross over the first loops in the N-th stage of the first course, and the second loops are formed at the positions of the knitting needles 2*b* on one side, to form a second cross element between the knitting needles 2*b* on one side. Thus, the N+1-th stage of the second course including the second loops and the second cross element connecting the second loops to each other and crossing over the first loops in the N-th stage is knitted (step of knitting the N+1-th stage of the second course). (3) Next, the second knitting yarn 10B is fed from the second yarn feeder 40B only to the knitting needles 2*f* on the other side in one of the directions so as to cross over the first loops in the N-th stage of the first course and the second loops in the N+1-th stage of the second course, and the second loops are formed at the positions of the knitting needles 2*f* on the other side, to form a second cross element between the knitting needles 2*f* on the other side. Next, the second knitting yarn 10B is fed from the second yarn feeder 40B only to the knitting needles 2*b* on the other side in the other of the directions so as to cross over the first loops in the N-th stage of the first course and the second loops in the N+1-th stage of the second course, and the second loops are formed at the positions of the knitting needles 2*b* on the other side, to form a second cross element between the knitting needles 2*b* on the other side. Thus, the N+2-th stage of the second course including the second loops and the second cross element connecting the second loops to each other and crossing over the first loops in the N-th stage of the first course and the second loops in the N+1-th stage of the second course is knitted (step of knitting the N+2-th stage of the second course). (4) Next, the first knitting yarn 10A is fed from the first yarn feeder 40A to the knitting needles 1*f* in one of the directions so as to cross over the second loops in the N+1-th stage and the N+2-th stage of the second course, and the first loops provided continuously with the first loops in the N-th stage are formed at the positions of the knitting needles 1*f*, to form a first cross element between the knitting needles 1*f*. Next, the first knitting yarn 10A is fed from the first yarn feeder 40A to the knitting needles 1*b* in the other of the directions so as to cross over the second loops in the N+1-th stage and the N+2-th stage of the second course, and the first loops provided continuously in the N-th stage are formed at the positions of the knitting needles 1*b* to form a first cross element between the knitting needles 1*b*. Thus, the N+3-th stage of the first course including the first loops and the first cross element connecting the first loops to each other and crossing over the second loops in the N+1-th stage and the N+2-th stage of the second course is knitted (step of knitting the N+3-th stage of the first course). (5) Next, the second knitting yarn 10B is fed from the second yarn feeder 40B to the knitting needles 2*f* on one side in one of the directions so as to cross over the second loops in the N+2-th stage of the second course and the first loops in the N+3-th stage of the first course, and the second loops provided continuously with the second loops in the N+1-th stage are formed at the positions of the knitting needles 2*f* on one side, to form a second cross element between the knitting needles 2*f* on one side. Next, the second knitting yarn 10B is fed from the second yarn feeder 40B to the knitting needles 2*b* on one side in the other of the directions so as to cross over the second loops in the N+2-th stage of the second course and the first loops in the N+3-th stage of the first course, and the second loops provided continuously with the second loops in the N+1-th stage are formed at the positions of the knitting needles 2*b* on one side, to form a second cross element between the knitting needles 2*b* on one side. Thus, the N+4-th stage of the second course including the second loops and the second cross element connecting the second loops to each other and crossing over the second loops in the N+2-th stage of the second course, and the first loops in the N+3-th stage of the first course is knitted (steps of knitting the N+4-th stage of the second course). (6) Next, the second knitting yarn 10B is fed from the second yarn feeder 40B to the knitting needles 2*f* on the other side in one of the directions so as to cross over the first loops in the N+3-th stage of the first course and the second loops in the N+4-th stage of the second course, and the second loops provided continuously with the second loops in the N+2-th stage are formed at the positions of the knitting needles 2*f* on the other side, to form a second cross element between the knitting needles 2*f* on the other side. Next, the second knitting yarn 10B is fed from the second yarn feeder 40B to the knitting needles 2*b* on the other side in the other of the directions so as to cross over the first loops in the N+3-th stage of the first course and the second loops in the N+4-th stage of the second course, and the second loops provided continuously with the second loops in the N+2-th stage are formed at the positions of the knitting needles 2*b* on the other side, to form a second cross element between the knitting needles 2*b* on the other side. Thus, the N+5-th stage of the second course including the second loops and the second cross element connecting the second loops to each other and crossing over the first loops in the N+3-th stage of the first course and the second loops in the N+4-th stage of the second course is knitted (step of knitting the N+5-th stage of the second course). (7) The loops are provided continuously in the wale direction by repeating steps (4) to (6) described above. As described above, the knitted fabric 100 according to the third embodiment is produced.

Fourth embodiment

Figure 9A:
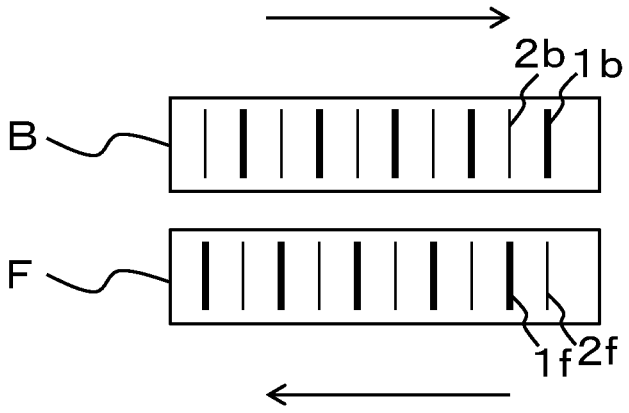
FIG. 9A is a view showing the arrangement of knitting needles in needle beds for producing the knitted fabric contained in the knitted glove according to the fourth embodiment of the present invention.
Figure 9B:
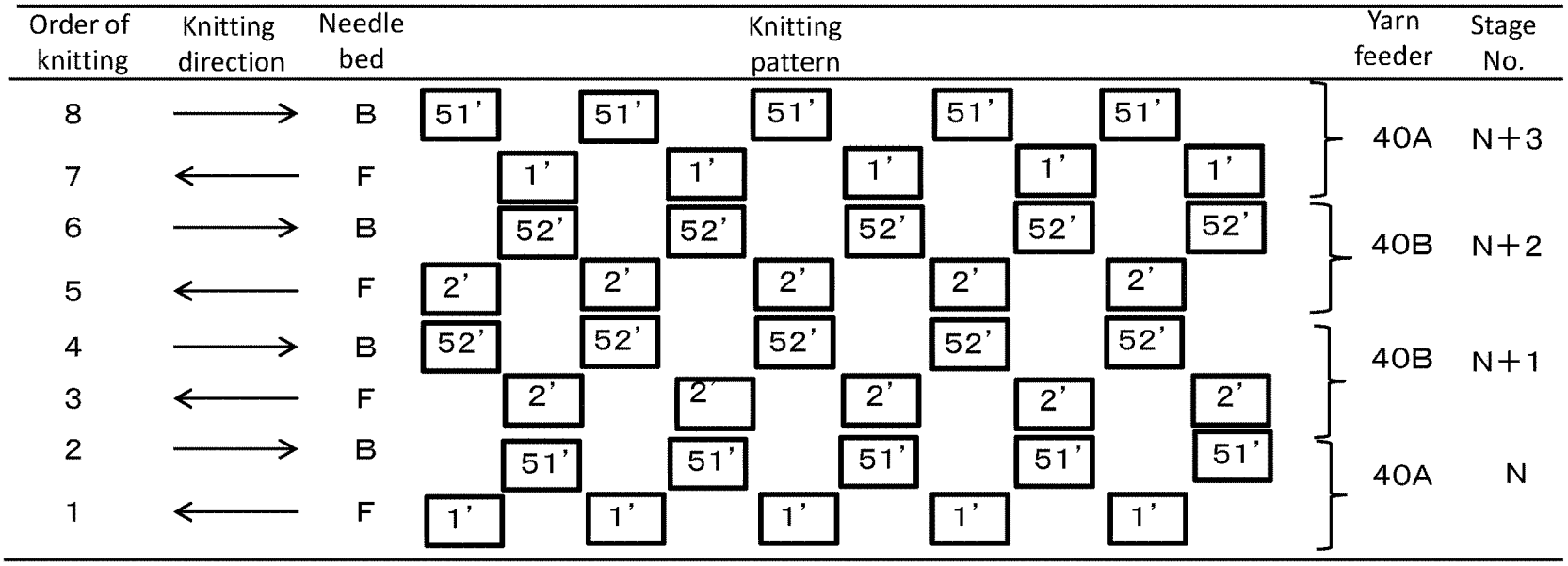
FIG. 9B is a formation diagram used for producing the knitted fabric contained in the knitted glove according to the fourth embodiment of the present invention.

Next, a method for producing the knitted fabric 100 according to the fourth embodiment will be described with reference to FIGS. 9A and 9B. In this embodiment, the knitted fabric 100 is produced while alternately replacing the first knitting yarn 10A with the second knitting yarn 10B when knitting the courses of the N+2-th stage and its subsequent stages. Specifically, in the case where the course in the N-th stage is knitted by the first knitting yarn 10A, the course in the N+2-th stage is knitted by the second knitting yarn 10B, and in the case where the course in the N+1-th stage is knitted by the second knitting yarn 10B, the course in the N+3-th stage is knitted by the first knitting yarn 10A. In this embodiment, the knitting needles if or 2*f* are used for forming first loops in 1', and the knitting needles 1*b* or 2*b* are used for forming first loops in 51'. Further, the knitting needles if or 2*f* are used for forming the second loops in 2', and the knitting needles 1*b* or 2*b* are used for forming the second loops in 52'. Also in FIG. 9A, the number of knitting needles is smaller than the number of knitting needles that are actually provided in the needle beds F and B.

In this embodiment, the knitted fabric 100 is produced as follows. (1) The N-th stage of the first course including first loops and the first cross element configured to connect the first loops to each other is knitted in the same manner as in step (1) of the first embodiment (step of knitting the N-th stage of the first course). (2) The N+1-th stage of the second course including the second loops and the second cross element configured to connect the second loops to each other is knitted in the same manner as in step (2) of the first embodiment (step of knitting the N+1-th stage of the second course). (3) Next, the loops and the cross element are formed in the same manner as in step (3) of the first embodiment except that the knitting needles if and 1*b* used for knitting the N-th stage of the first course, another knitting yarn (in the case of the N+2-th stage, the second knitting yarn 10B) different from the knitting yarn just previously knitted by the knitting needles if and 1*b* is used. Thus, the N+2-th stage of the second course including the second loops formed in the N+2-th stage by the second knitting yarn 10B and the second cross element connecting the second loops to each other and crossing over the second loops in the N+1-th stage of the second course is knitted (step of knitting the N+2-th stage of the second course). (4) Next, the loops and the cross element are formed in the same manner as in step (4) of the first embodiment except that another knitting yarn (in the case of the N+3-th stage, the first knitting yarn 10A) different from the knitting yarn just previously knitted by the knitting needles 2*f* and 2*b* used for knitting the N+1-th stage of the second course is used in the knitting needles 2*f* and 2*b*. Thus, the N+3-th stage of the first course including the first loops formed in the N+3-th stage by the first knitting yarn 10A and the first cross element connecting the first loops to each other and crossing over the second loops in the N+2-th stage of the second course is knitted (step of knitting the N+3-th stage of the first course). (5) The loops are provided continuously in the wale direction by alternately repeating steps (1) to (4) described above. As described above, the knitted fabric 100 according to the fourth embodiment is produced.

The knitted glove of this embodiment includes a knitted fabric, and the knitted fabric includes: multiple stages of a first course each of which has a plurality of first loops and a first cross element configured to connect the first loops to each other and in which the plurality of first loops are aligned in the course direction; and multiple stages of a second course in each of which a plurality of second loops are aligned in the course direction, wherein a first knitting yarn constituting the first course has an elongation rate of 12.5% or more, the second knitting yarn constituting the second course has a yarn containing a cut resistant fiber, between at least one set of two adjacent first loops in one stage of the first course, a loop in another stage of the courses is arranged, and the first cross element is knitted so as to cross over the loop. According to the knitted glove having such a configuration, the first knitting yarn constituting the first course has elasticity, and therefore the knitted fabric can stretch and shrink following the motion of the hand of the wearer. Thus, the knitted glove according to the present invention has excellent flexibility and excellent comfort in wearing, comparatively. Further, the thickness of the glove increases due to the shrinkage of the first knitting yarn, and further the second knitting yarn constituting the second course has cut resistance. Therefore, the knitted glove according to the present invention has comparatively excellent cut resistance.

In the aforementioned knitted glove, the configuration may be such that the second course further has a second cross element configured to connect the second loops to each other, between at least one set of two adjacent second loops in one stage of the second course, a loop in another stage of the courses is arranged, and the second cross element is knitted so as to cross over the loop. According to such a configuration, the second cross element also crosses over the loops in another stage, and therefore the knitted fabric can have larger thickness. Further, since the intervention of the second cross element increases the spacing between the second loops, the yarn is loosened, and the flexibility of the knitted fabric increases. Thus, the aforementioned knitted glove has more excellent cut resistance.

In the aforementioned knitted glove, the configuration may be such that the first knitting yarn includes a composite yarn that has a core material containing an elastic fiber, and a coating layer formed by winding a coating fiber around the outer circumference of the core material. According to such a configuration, the outer circumference of the core material containing an elastic fiber having small tensile strength and poor cut resistance can be protected by the coating layer, and therefore the first knitting yarn can be less likely to be broken. That is, the cut resistance of the first knitting yarn can be enhanced. Thus, the aforementioned knitted glove has more excellent cut resistance.

In the aforementioned knitted glove, the configuration may be such that the second knitting yarn includes a composite yarn that has a core material containing a cut resistant fiber, and a coating layer formed by winding a coating fiber around the outer circumference of the core material. According to such a configuration, the outer circumference of the core material of the cut resistant fiber can be protected by the coating layer, and therefore the second knitting yarn can be less likely to be broken. That is, the cut resistance of the second knitting yarn can be enhanced. Thus, the aforementioned knitted glove has more excellent cut resistance.

The method for producing a knitted fabric contained in the knitted glove of the present invention includes: a plurality of first course knitting steps of knitting a first course using a first knitting yarn by aligning a plurality of first loops in the course direction so as to be connected to each other by a first cross element; and a plurality of second course knitting steps of knitting a second course using a second knitting yarn by aligning a plurality of second loops in the course direction, wherein at least one of the plurality of first course knitting steps is a step of knitting the first course so that the first cross element crosses over a loop in another stage of the courses, the first knitting yarn constituting the first course has an elongation rate of 12.5% or more, and the second knitting yarn constituting the second course includes a yarn containing a cut resistant fiber. The knitted glove including a knitted fabric produced by such a production method has excellent flexibility, excellent comfort in wearing, and excellent cut resistance, comparatively.

In the aforementioned method for producing a knitted fabric contained in the knitted glove, using a flat knitting machine including needle beds having knitting needles provided side by side in a direction in which the courses of the knitted fabric extend, a first yarn feeder configured to feed the first knitting yarn to knitting needles, and a second yarn feeder configured to feed the second knitting yarn to knitting needles, at least one of the first course knitting steps may be forming the first cross element so as to cross over a loop formed by the knitting needle that has not been used above in the first course knitting step among the loops in the course knitted in the one-step-ahead course knitting step by feeding the first knitting yarn from the first yarn feeder to a knitting needle in the needle beds without using at least one of the knitting needles that have been used in a course knitting step ahead of the first course knitting step. The knitted glove including a knitted fabric produced by such a production method has excellent flexibility, excellent comfort in wearing, and excellent cut resistance, comparatively. Further, the knitted fabric can be produced using an existing flat knitting machine.

In the aforementioned method for producing a knitted fabric, at least one of the second course knitting steps may be forming the second cross element so as to cross over a loop formed by the knitting needle that has not been used above among the loops in the course knitted in the one-step-ahead course knitting step by feeding the second knitting yarn from the second yarn feeder to a knitting needle in the needle beds without using at least one of the knitting needles used in a course knitting step ahead of the second course knitting step. In the knitted glove including a knitted fabric produced by such a production method, the second cross element in one stage also crosses over the loops in another stage of the courses, and therefore the thickness of the knitted fabric is more increased. Further, since the intervention of the second cross element increases the spacing between the second loops, the yarn is loosened, and the flexibility of the knitted fabric increases. Thus, the knitted glove has more excellent cut resistance and more excellent flexibility.

The knitted glove of the present invention and the method for producing a knitted fabric contained in the knitted glove are not limited to the aforementioned embodiments, and various modifications can be, of course, made without departing from the gist of the present invention.

In the aforementioned embodiments, the first course knitted using the first knitting yarn may be replaced with the second course knitted using the second knitting yarn. Even if the knitted fabric is knitted in this way, the first cross element in one stage of the first course crosses over the first loop in another stage of the first course or the second loop in another stage of the second course, and therefore the first cross element can stretch and shrink. Therefore, the knitted glove containing the aforementioned knitted fabric also can exert the effects of the present invention.

In the aforementioned embodiments, the knitted glove including the knitted fabric knitted using the first knitting yarn and the second knitting yarn have been described, but the knitted fabric may be knitted using a third knitting yarn in addition to the first knitting yarn and the second knitting yarn. Examples of the third knitting yarn include a yarn containing a meta-aramid fiber for heat resistance or an acrylic fiber for cold protection. Even if the knitted fabric is knitted in this way, the first cross element in one stage of the first course knitted using the first knitting yarn crosses over at least any one of the first loops in another stage of the first course, the second loops in another stage of the second course, or the third loops in another stage of the third courses, and therefore the first cross element can stretch and shrink. Therefore, the knitted glove containing the aforementioned knitted fabric also can exert the effects of the present invention.

Further, with the aforementioned knitted glove serving as a base, a resin coating or a rubber coating may be provided so as to at least partially cover the base glove.

EXAMPLES

Hereinafter, the present invention will be described more in detail by way of examples. The following examples are shown for describing the present invention further in detail, and the scope of the present invention is not limited thereto.

Example 1

Using an elastic composite yarn for the first knitting yarn and a yarn combining a metal composite yarn and an elastic composite yarn for the second knitting yarn, a knitted glove was produced by a flat knitting machine. The elastic composite yarn was produced as follows. That is, it was produced, using a 78-dtex spandex as a core material, by winding a 78-dtex woolly nylon two-ply yarn(total 310dtex) as a coating fiber around the outer circumference of the core material at 300 TPM (twist per meter) in one direction to a draft of 3.0 and thereafter winding the 78-dtex woolly nylon two-ply yarn therearound at 300 TPM in the opposite direction to the previous winding. The metal composite yarn was produced as follows. That is, it was produced, using a 30-μm diameter stainless steel wire as a core material and a 167-dtex polyester filament yarn as an additional yarn in combination, by winding a 83-dtex woolly polyester two-ply yarn(total 330dtex) as a coating fiber around the outer circumference of the aforementioned materials at 634 TPM in one direction and thereafter winding the same 83-dtex woolly polyester two-ply yarn therearound at 634 TPM in the opposite direction to the previous winding. Second loops were formed in the second knitting yarn plated so that the elastic composite yarn was arranged inside the glove, and the metal composite yarn was arranged outside the glove. The value of the elongation rate of the first knitting yarn, as measured according to the following method, was 128.6%. Further, the value of the tensile strength of the 30-μm diameter stainless steel wire in the second knitting yarn, as measured according to the following method, was 2700 $N/mm^2$. Further, SWG061N2 (manufactured by SHIMA SEIKI MFG., LTD.) was used as the flat knitting machine. The knitting pattern shown in FIG. 6B was used, and the stitch value set in the machine was 45.

<Method for Measuring Elongation Rate>

(1) One end of the first knitting yarn with a length of 50 cm was held by a clamp, and a load of 30 g was applied thereto with the first knitting yarn hanging downward. (2) After the lapse of 10 seconds, a mark was provided at a position (L2) of 40 cm from the one end of the first knitting yarn in the hanging direction, and thereafter the load of 30 g was removed from the first knitting yarn, which was held for 2 minutes. (3) Next, a load of 0.25 g was applied thereto with the first knitting yarn hanging downward, and after the lapse of 10 seconds, the length (L1) from the one end of the first knitting yarn to the mark was measured. (4) Using the values of L1 and L2, the elongation rate was calculated by rounding off to one decimal place by the formula of (L2-L1)/L1×100. (5) The values of the elongation rate determined by performing steps (1) to (4) 20 times were arithmetically averaged.

<Method for measuring tensile strength>

The tensile strength was measured according to chapter 8.5.1 in the test methods for chemical fiber filament yarns of JIS L 1013.

Example 2

A knitted glove was produced in the same manner as in Example 1 except that a yarn combining a metal composite yarn and an elastic composite yarn was used for the first knitting yarn, and a metal composite yarn was used for the second knitting yarn. In this example, the first knitting yarn was formed by combining two or more yarns, and therefore the first knitting yarn was measured according to the following method. Further, the tensile strength of the second knitting yarn was measured by the same method as in Example 1. The value of the elongation rate of the first knitting yarn, as measured according to the following method, was 122.2%.

<Method for measuring elongation rate>

(1') One end of each of the yarns constituting the first knitting yarn with a length of 50 cm was held by a clamp, and a load of 30 g was applied to each yarn hanging downward. (2') After the lapse of 10 seconds, a mark was provided at a position (L2) of 40 cm from the one end of each yarn in the hanging direction, and after the yarns were bundled at the marked positions, the load of 30 g was removed from the yarns, which were held for 2 minutes. (3') Next, with the bundled yarns hanging downward, a load of 0.25 g was applied thereto, and after the lapse of 10 seconds, the length (L1) from the one end of each yarn to the mark was measured. (4') After steps (1') to (3') were performed, steps (4) and (5) described in Example 1 were performed.

Example 3

A knitted glove was produced in the same manner as in Example 1 except that a metal composite yarn was used for the second knitting yarn. The value of the elongation rate of the first knitting yarn, as measured according to the method described in Example 1, was 128.6%.

Example 4

A knitted glove was produced in the same manner as in Example 1 except that a yarn combining a composite yarn having cut resistance and an elastic composite yarn other than the metal composite yarn was used for the first knitting yarn. The composite yarn having cut resistance other than the metal composite yarn was produced as follows. That is, it was produced, using 440-dtex polyparaphenylene terephthalamide filament yarns combined as a core material, by winding a 83-dtex woolly polyester two-ply yarn(total 330dtex) as a coating fiber around the outer circumference of the core material at 634 TPM in one direction and thereafter winding the same 83-dtex woolly polyester two-ply yarn therearound at 634 TPM in the opposite direction to the previous winding. The first loops were formed in the first knitting yarn plated so that the elastic composite yarn was arranged inside the glove, and the composite yarn having cut resistance other than the metal composite yarn was arranged outside the glove. The value of the elongation rate of the first knitting yarn, as measured according to the method described in Example 2, was 116.2%.

Comparative Example 1

A knitted glove was produced in the same manner as in Example 1 except that metal composite yarns were used for the first knitting yarn and the second knitting yarn. The value of the elongation rate of the first knitting yarn, as measured according to the method described in Example 1, was 0.8%.

Comparative Example 2

A knitted glove was produced in the same manner as in Example 1 except that an elastic composite yarn was used for the second knitting yarn. The value of the elongation rate of the first knitting yarn, as measured according to the method described in Example 1, was 128.6%. In the second knitting yarn, the value of the tensile strength of the spandex was 115.7 N/mm$^2$, and the value of the tensile strength of the woolly nylon two-ply yarn was 468.0 N/mm$^2$, as measured according to the method of Example 1.

The measurement results of the thickness, cut resistance, and flexibility of the knitted glove of the aforementioned examples and the evaluation results of the internal texture of the glove are shown in Table 1. The thickness, cut resistance, and flexibility of the glove were measured by the following methods. Further, the internal texture of the glove was evaluated by the following sensory test. In Table 1, DCY represents an elastic composite yarn, M-DCY represents a metal composite yarn, and NMCR-DCY represents a composite yarn having cut resistance other than the metal composite yarn. Further, M-DCY/DCY means plating knitting using M-DCY and DCY, and NMCR-DCY/DCY means plating knitting using NMCR-DCY and DCY.

<Thickness of glove>

Using a thickness gauge PG-15, manufactured by TECLOCK CORPORATION, the thickness was measured according to JIS L 1096. A probe having a surface contacting the glove with an area of 1 cm$^2$ was used, and the pressure applied during the measurement was set to 240 gf/cm$^2$.

<Cut resistance>

The cut resistance was measured according to ISO13997-1999.

<Flexibility>

A specimen cut to a width of 40 mm×a length of 60 mm from a four body part on the back hand side of the knitted glove according to each example was used. In the cutting, the length direction of the specimen was allowed to coincide with the length direction of the fingers of the knitted glove. Using a desktop precision universal tester (type: AGS-J, manufactured by SHIMADZU CORPORATION) as a tester, the indication value of the force applied when the distance between chucks was set to 40 mm, and the specimen was stretched at a tensile speed of 50 mm/min to a distance between chucks of 80 mm was recorded. The smaller the indication value when it is stretched to a distance between chucks of 80 mm, it was determined to have more excellent flexibility.

<Internal texture of glove>

5 panelists wore the knitted glove of each example, and the feeling sensed when the knitted glove was worn was selected by the panelists from the following stepwise scales:

1. Feel exceptionally rough and therefore exceptionally uncomfortable in wearing;
2. Feel rough and therefore uncomfortable in wearing;
3. Feel rough but not uncomfortable in wearing; and
4. Hardly feel rough and therefore comfortable in wearing.

TABLE 1

| | First knitting yarn | Second knitting yarn | Thickness [mm] | Cut resistance [g] | Flexibility [N] | Internal texture |
|---|---|---|---|---|---|---|
| Example 1 | DCY | M-DCY/DCY | 1.53 | 4100 | 19.0 | 4 |
| Example 2 | M-DCY/DCY | M-DCY | 1.40 | 3900 | 26.4 | 3 |
| Example 3 | DCY | M-DCY | 1.35 | 3500 | 5.5 | 3 |
| Example 4 | NMCR-DCY/DCY | M-DCY/DCY | 1.45 | 6400 | 67.2 | 3 |
| Comparative Example 1 | M-DCY | M-DCY | 0.80 | 3200 | 75.5 | 1 |
| Comparative Example 2 | DCY | DCY | 1.36 | 440 | 6.1 | 4 |

The knitted glove according to Examples 1 to 4 had large thickness, excellent cut resistance, excellent flexibility, and excellent internal texture, altogether, as compared with the knitted glove according to Comparative Example 1 using only the metal composite yarns for both of the first knitting yarn and the second knitting yarn. Further, the knitted glove according to Examples 1 and 2 had large thickness, excellent cut resistance, and excellent flexibility, as compared with the knitted glove according to Comparative Example 2 using the elastic composite yarns for both of the first knitting yarn and the second knitting yarn. Further, as compared with the knitted glove according to Comparative Example 2, the knitted glove according to Example 3 had the same thickness but had excellent cut resistance and excellent flexibility. Further, the knitted glove according to Example 4 had poor flexibility but had large thickness and excellent cut resistance, as compared with the knitted glove according to Comparative Example 2.

The above-described embodiments and examples are illustrative of the present invention and do not limit the scope of the present invention. That is, the scope of the present invention is not defined by the embodiments and examples but by the claims. Various modifications which are made within the scope of the claims and within the meaning of the invention equivalent thereto are considered to be within the scope of the present invention.

REFERENCE SIGNS LIST

1, 2: Knitting needle
10A: First knitting yarn
10B: Second knitting yarn
11: First loops
12: Second loops
21: First cross element
22: Second cross element
31: First course
32: Second course
40A: First yarn feeder
40B: Second yarn feeder
F: Front needle bed
B: Rear needle bed
100: Knitted fabric
200: Flat knitting machine

What is claimed is:

1. A knitted glove comprising a knitted fabric, the knitted fabric comprising:

a plurality of stages of a first course, each of which has a plurality of first loops and a first cross element configured to connect the first loops to each other and comprises a first knitting yarn and in which the plurality of first loops are aligned in a course direction; and a plurality of stages of a second course, each of which has a plurality of second loops and comprises a second knitting yarn and in which the plurality of second loops are aligned in the course direction, wherein the first knitting yarn has an elongation rate of 12.5% or more, the second knitting yarn has a yarn containing a cut resistant fiber, between at least one set of two adjacent first loops in one stage of the first course, a loop in another stage of the courses is arranged, and the first cross element is knitted so as to cross over the loop.

2. The knitted glove according to claim 1, wherein the second course further comprises a second cross element configured to connect the second loops each other, between at least one set of two adjacent second loops in one stage of the second course, a loop in another stage of the courses is arranged, and the second cross element is knitted so as to cross over the loop.

3. The knitted glove according to claim 1, wherein the first knitting yarn comprises a composite yarn that has a core material containing an elastic fiber, and a coating layer formed by winding a coating fiber around the outer circumference of the core material.

4. The knitted glove according to claim 1, wherein the second knitting yarn comprises a composite yarn that has a core material containing a cut resistant fiber, and a coating layer formed by winding a coating fiber around the outer circumference of the core material.

* * * * *